US008075388B1

(12) United States Patent
Bennett

(10) Patent No.: US 8,075,388 B1
(45) Date of Patent: Dec. 13, 2011

(54) MULTIPLE-GAME GAMING MACHINE

(75) Inventor: Nicholas Luke Bennett, Rosebery (AU)

(73) Assignee: Aristocrat Technologies Australia Pty Limited (AU)

( * ) Notice: Subject to any disclaimer, the term of this patent is extended or adjusted under 35 U.S.C. 154(b) by 0 days.

(21) Appl. No.: 10/148,622

(22) PCT Filed: Nov. 24, 2000

(86) PCT No.: PCT/AU00/01430

§ 371 (c)(1),
(2), (4) Date: May 31, 2002

(87) PCT Pub. No.: WO01/39856

PCT Pub. Date: Jun. 7, 2001

(30) Foreign Application Priority Data

Dec. 2, 1999 (AU) ..... PQ4470

(51) Int. Cl.
*A63F 9/24* (2006.01)

(52) U.S. Cl. ..... 463/20; 463/16; 463/17; 463/18; 463/19; 463/25

(58) Field of Classification Search ..... 463/16–22, 463/25; 273/138.1, 143 R
See application file for complete search history.

(56) References Cited

U.S. PATENT DOCUMENTS 4,856,787 A 8/1989 Itkis
5,231,568 A * 7/1993 Cohen et al. ..... 705/14
5,342,047 A 8/1994 Heidel
5,393,061 A * 2/1995 Manship et al. ..... 463/20
5,664,998 A * 9/1997 Seelig et al. ..... 463/20
5,704,835 A * 1/1998 Dietz, II ..... 463/20
5,722,891 A 3/1998 Inoue
5,851,148 A 12/1998 Brune
6,077,163 A * 6/2000 Walker et al. ..... 463/26
6,126,542 A * 10/2000 Fier ..... 463/16
6,173,955 B1 * 1/2001 Perrie et al. ..... 273/146
6,364,768 B1 * 4/2002 Acres et al. ..... 463/25
6,439,993 B1 * 8/2002 O'Halloran ..... 463/16
6,443,452 B1 * 9/2002 Brune ..... 273/143 R
6,554,704 B2 * 4/2003 Nicastro et al. ..... 463/20

(Continued)

FOREIGN PATENT DOCUMENTS

AU 199887937 B2 3/1999

(Continued)

OTHER PUBLICATIONS

Marshall Fey, Slot Machines, A Pictorial History of the First 100 Years, Fifth Edition, Liberty Belle Books, 1997, pp. 59, 204.*

(Continued)

*Primary Examiner* — Omkar Deodhar
(74) *Attorney, Agent, or Firm* — McAndrews, Held & Malloy Ltd.

(57) ABSTRACT

A gaming machine includes a gaming console. A display is mounted in the gaming console for displaying a wagering game and its result. A controller controls operation of the game, the controller displaying the result of a first game on the display, making payment of a prize if the first game has a prize winning result and, thereafter, irrespective of the result of the first game, varying a result displayed on the display without requiring any additional wager by a player whether before or after completion of the first game.

23 Claims, 7 Drawing Sheets

U.S. PATENT DOCUMENTS

2003/0157978 A1* 8/2003 Englman ..... 463/16

FOREIGN PATENT DOCUMENTS

| | | | | |
|---|---|---|---|---|
| AU | A 84162/98 | | | 3/1999 |
| AU | 199923720 | | | 10/1999 |
| EP | 60019 | A1 | * | 9/1982 |
| GB | 2239547 | A | * | 7/1991 |
| GB | 2262642 | A | * | 6/1993 |
| GB | 2338578 | A | | 12/1999 |
| WO | WO 99/10849 | | | 3/1999 |
| WO | WO 99/66464 | | | 12/1999 |
| WO | WO 01/12281 | A1 | | 2/2001 |

OTHER PUBLICATIONS

"Slot Machines, A pictorial History of the First 100 Years," Marshall Fey, p. 59.*

* cited by examiner

MULTIPLE-GAME GAMING MACHINE

The present application is a 35 U.S.C. 371 application of PCT/AU00/01430, filed Nov. 24, 2000, which claims the benefit of AU application PQ4470, filed Dec. 2, 1999.

FIELD OF THE INVENTION

The present invention relates to a gaming machine. More particularly, the invention relates to a gaming machine of the type known as a slot machine, a fruit machine or a poker machine. Certain types of the machines in question have a series of rotatable reels each of which displays a series of symbols or a video simulation of such reels. Other types of machines are arranged to play video simulations of card games or other wagering games such as bingo or keno. The invention relates particularly to an improvement to a game played on such a machine.

BACKGROUND TO THE INVENTION

As gaming machines develop, players become used to certain styles of games. Therefore, it is necessary for manufacturers of the machines to develop new game features which add interest to the games provided on such machines in order to keep the players entertained and willing to continue to play the games.

Gaming machines of the type described are particularly well known nationally and internationally. Substantial amounts of money are wagered on these machines. There is a growing tendency to legalise the use of gaming machines by licensing operators which results in revenue gains being achieved through license fees and taxation of moneys invested. The licensed operation of gaming machines is the subject of state legislation and regulation. Amongst the items regulated is the minimum percentage pay out for a gaming machine. For example, in New South Wales, Australia, a minimum of 85% of moneys invested must be returned as winnings and manufacturers of gaming machines must therefore design the machines around these regulatory controls.

With the growth that has occurred in the gaming machine market, there is intense competition between manufacturers to supply the various existing and new venues. When selecting a supplier of gaming machines the operator of a venue must pay close attention to the popularity of various games with their patrons. In addition, the operators of such venues must endeavour to keep their patrons entertained to maintain their loyalty and also to encourage new players. Hence, it is necessary to continuously provide more variety on these gaming machines and new features in relation to the machines.

In addition, tokenisation has made it possible to offer games having very low monetary denominations, for example, as low as one cent. Even with such low denominations, it is desirable to offer innovative features.

SUMMARY OF THE INVENTION

According to the invention, there is provided a gaming machine which includes:

a gaming console;

a display means mounted in the gaming console, the display means being operable to display a wagering game and its result; and a control means for controlling operation of the game, the control means being operable to display the result of a first game on the display means, to make payment of a prize if the first game has a prize winning result and, thereafter, independently of the result of the first game, to vary images displayed on the display means without requiring any additional wager by a player whether before or after completion of the first game.

Preferably, the result is varied without intervention of the player to provide a player with at least two games for the price of a single wager.

In one embodiment of the invention, as a result of the varying of the result, a game sequence may be awarded to the player where the game sequence comprises at least two of the same game. In the case of a spinning reel game, this may entail all the reels being re-spun after any prizes have been paid as a result of the first game. Instead, only some of the reels may be re-spun with the remaining reels being held.

In another embodiment, as a result of the varying of the result, a game sequence may be awarded to the player where the game sequence comprises at least two different games. The different games may be mathematically different where the games of the sequence have different rules or odds, different reel strips (in the case of a spinning reel game), different prizes or different prize combinations, etc. In addition, or instead, the games of the sequence may be visually different where different themes, symbols, features distinguish the games from each other.

Further, the game sequence may comprise at least two different styles or types of games. Thus, a first game may be a spinning reel game and a second game may be a card game. Instead, the first game may be a five reel spinning reel game and the second game may be a three reel spinning reel game.

In yet a further embodiment, predetermined symbols appearing in the result of the first game and predetermined symbols appearing after the result has been varied at least once may together constitute a trigger condition for triggering a bonus feature.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
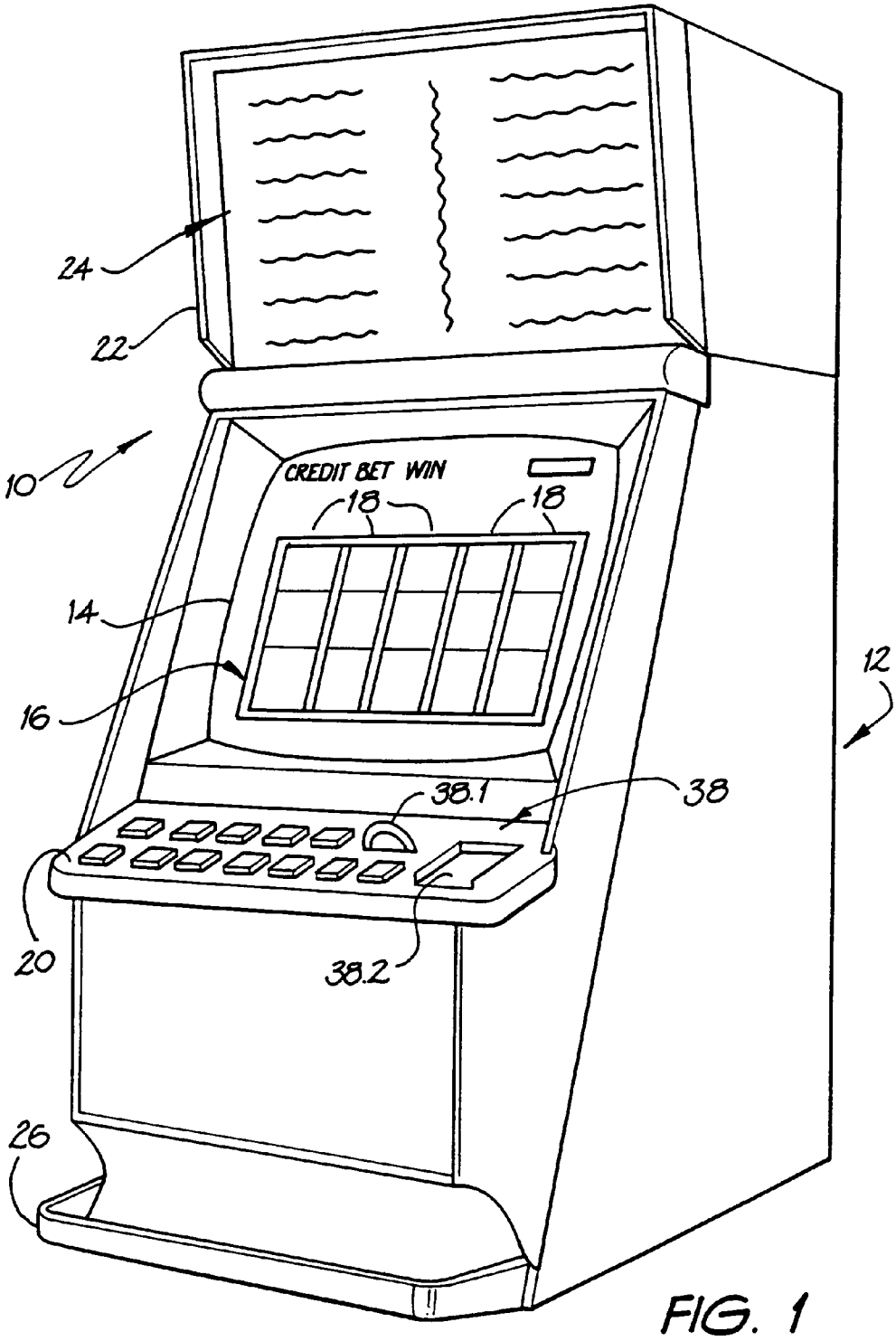
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14. The video display unit 14 includes a screen 16. Reels or reel strips 18 are simulated on the screen 16. A keypad 20 is provided on the console 12. The keypad 20 is used for enabling a player to actuate the game of the machine 10 to cause a video simulation of spinning of the reels 18. It will be appreciated that, instead of the keypad 20, a handle could be mounted on a side of the console 12.

The machine 10 includes a top box 22 on which a paytable 24 is displayed.

A coin tray 26 is mounted beneath the console 12 for cash payouts from the machine 10.

Figure 2:
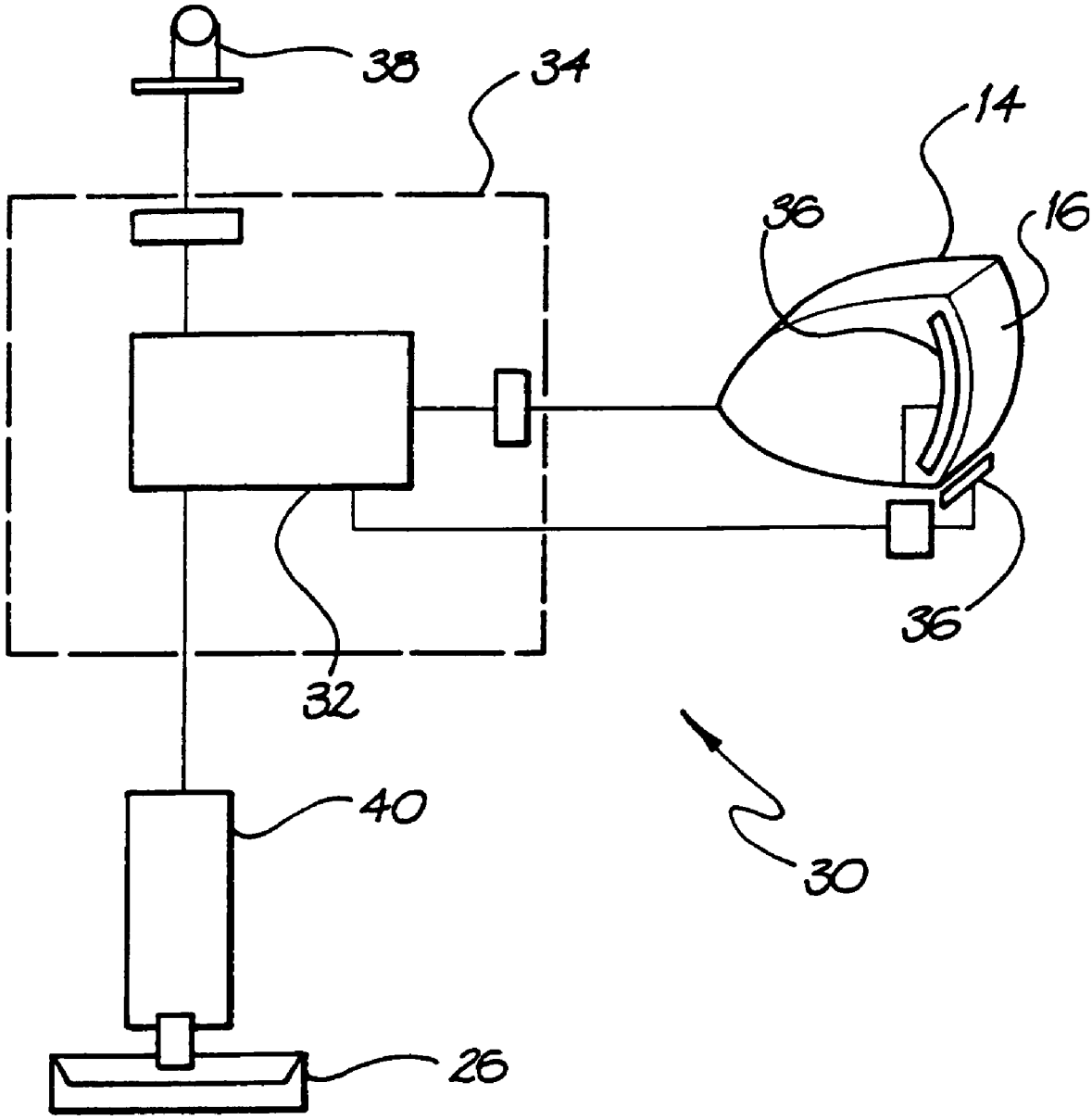
FIG. 2 shows a block diagram of a control circuit of the gaming machine.

Referring to FIG. 2 of the drawings, a control system 30 is illustrated. A program which implements the game and user interface is run on a processor 32 of the control system 30. The processor 32 forms part of a controller 34 which drives the screen 16 of the video display unit 14 and which receives input signals from sensors 36. The sensors 36 include sensors associated with the keypad 20. Instead, or in addition, the sensors 36 include touch sensors mounted in the screen 16.

The controller 34 also receives input pulses from a mechanism 38 indicating that a player has provided sufficient credit to begin playing. The mechanism 38 may be a coin input chute 38.1 (FIG. 1), a bill collector 38.2, a credit card reader (not shown), or any other type of validation device.

Finally, the controller 34 drives a payout mechanism 40 which, for example, may be a coin hopper for feeding coins to the coin tray 26 to pay out a prize once a predetermined combination of symbols carried on the reels 18 appears on the screen 16.

In this gaming machine 10, the processor 32 is configured to re-spin the reels 18 as will now be described.

Figure 3A:
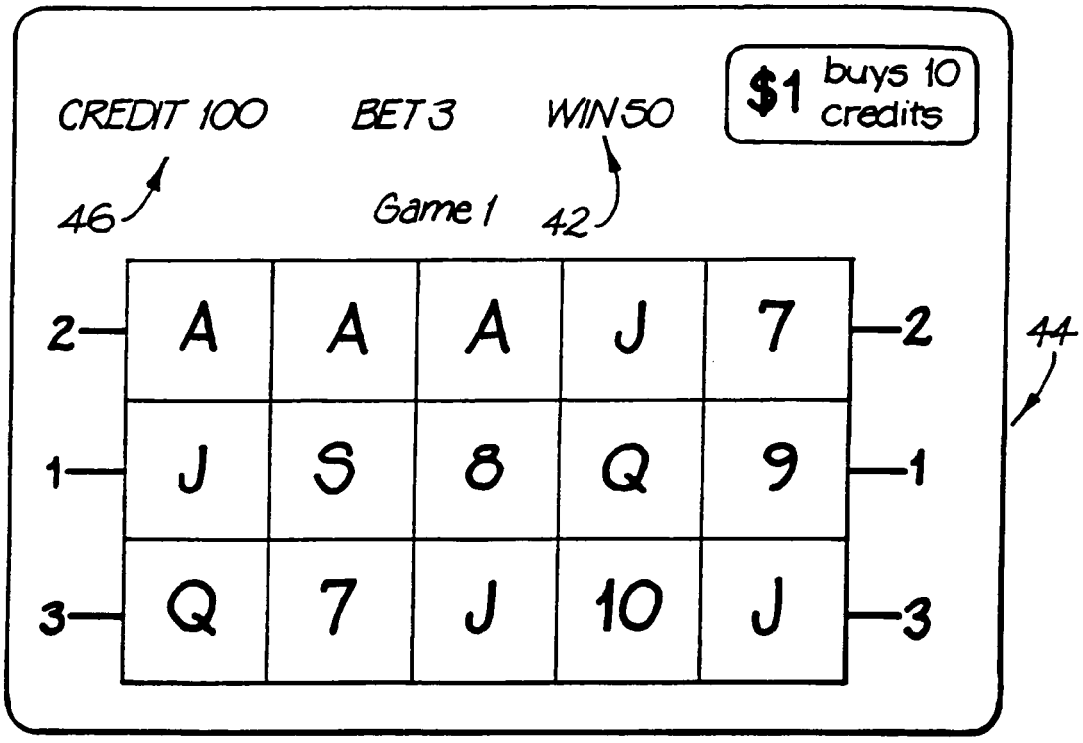
FIGS. 3*a* and 3*b* show screen displays of one embodiment of a game sequence of a game played on the gaming machine of FIG. 1.

When a player has sufficient credit in the machine 10, and the keypad 20 is operated to commence spinning of the reels 18, the reels 18 spin in a conventional fashion. If symbols on the reels appear in a prize winning arrangement on an active payline of the machine 10, a prize is awarded. Thus, in the example illustrated in FIG. 3*a* of the drawings, after an initial spin of the reels 18, a prize of 50 credits is awarded for 3×A on payline 2. as shown on a win meter 42 of a screen display 44. The prize can be paid to the player directly by paying out coins through the payout mechanism 40 into the coin tray 26 or the prize can be credited to a credit meter 46 of the machine 10.

Figure 3B:
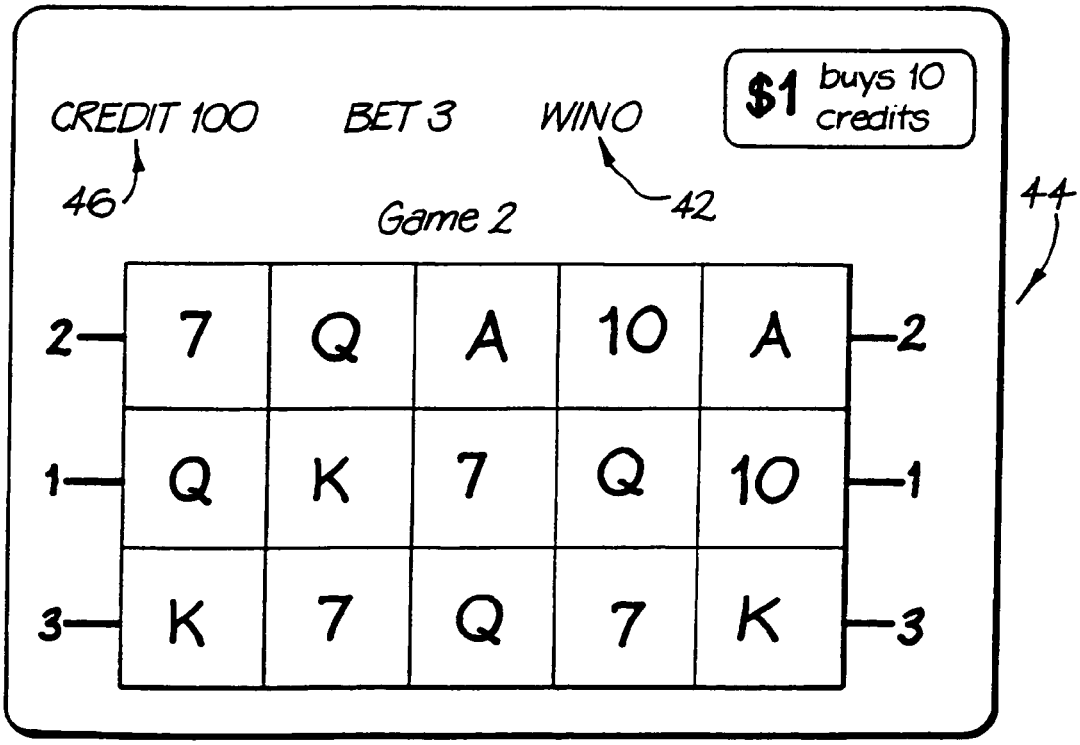

Then, without any further intervention of the player and without the player having to make an additional wager, all the reels 18 are re-spun to provide a second, different result as shown in FIG. 3*b* of the drawings. In other words, a second game is played under the control of the processor 32 without any intervention by the player. In the example shown in FIG. 3*b* of the drawings, no prize winning combination results. It will be appreciated that, instead of all the reels 18 being re-spun, certain of the reels 18 may be held with only some of the reels 18 being re-spun.

Figure 4A:
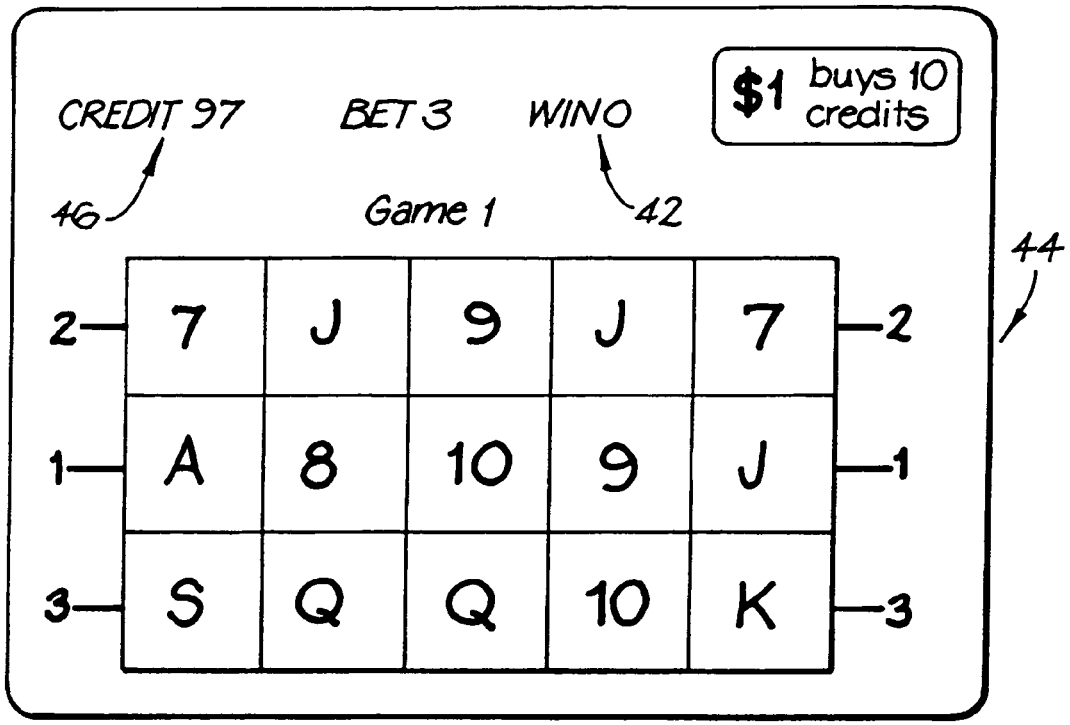
FIGS. 4*a* and 4*b* show screen displays of another embodiment of a game sequence of a game played on the gaming machine of FIG. 1.
Figure 4B:
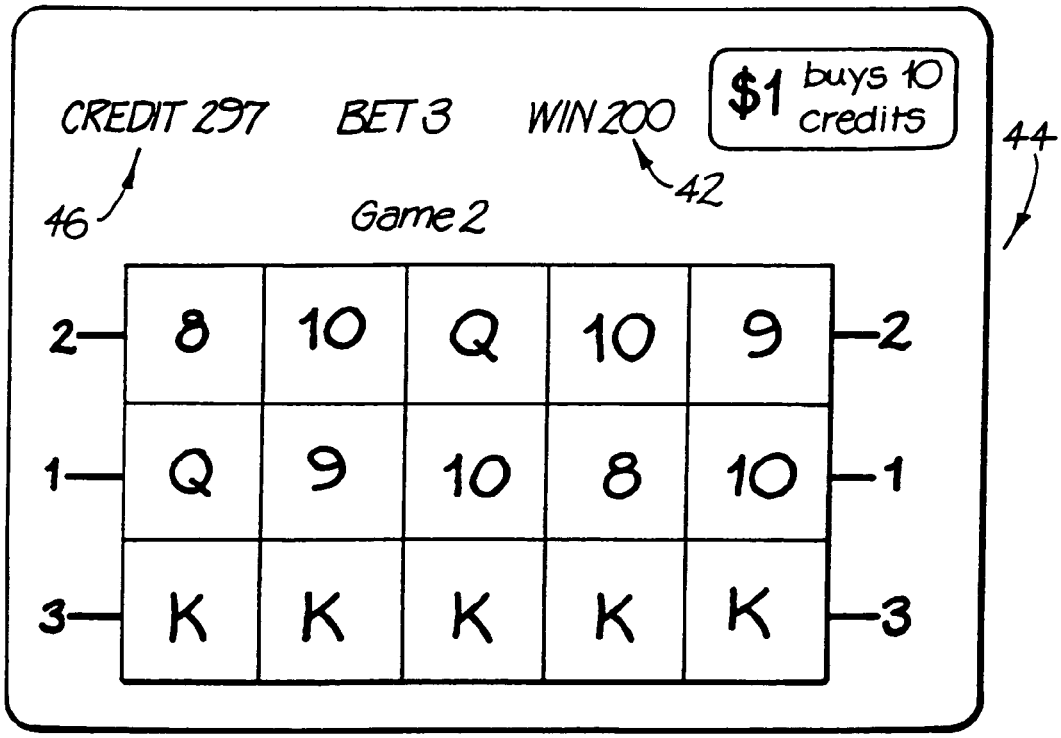
Figure 5:
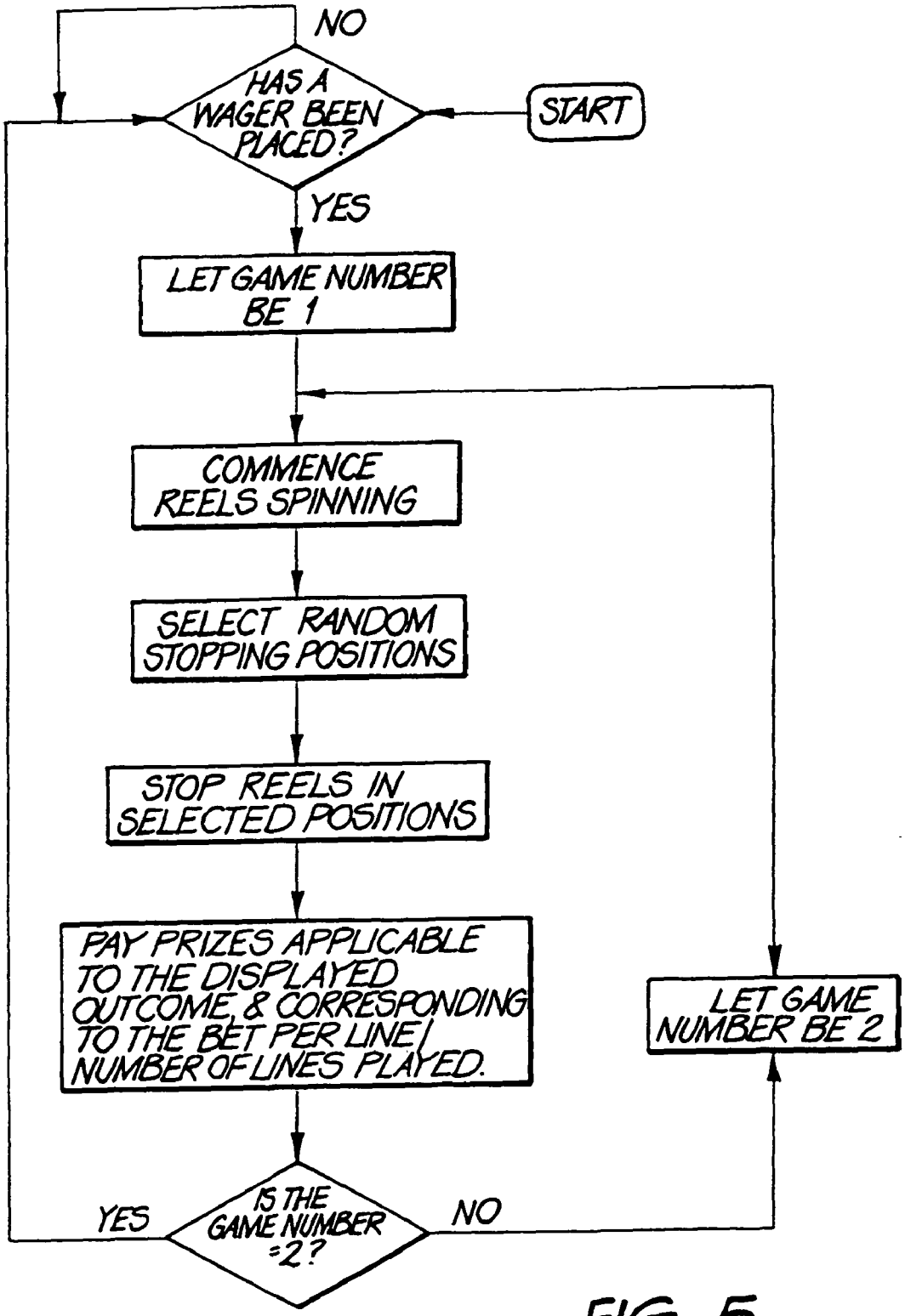
FIG. 5 shows a flow chart of the game sequence of FIG. 3 or FIG. 4.

In the embodiment shown in FIGS. 4*a* and 4*b* of the drawings, no prize winning combination of symbols occurs in the first game (FIG. 4*a*). However, this does not affect the playing of the second game and the re-spinning of the reels 18. Thus, the processor 32 re-spins the reels 18 irrespective of the result of the first game. After the reels 18 have been re-spun, the screen display 44 is as shown in FIG. 4*b* of the drawings. In this example, a prize of 200 credits is awarded for 5×K on payline 3.

Thus, in the above embodiments, at least two independent opportunities at the same game are given. Hence, all reels spin and a prize, if any, according to the result of where the reels stop spinning. Without any further cost to the player, all reels spin again and a prize, if applicable, is paid according to the new result. The paytable, symbols, winning combinations, reel strip layouts. etc. remain the same.

In another embodiment (not shown), at least two different games are given for one wager by the player. Thus, two different sets of reel strips, symbols and/or paytables could be provided. For example, a first game is played after the player has made his bet using a first set of reel strips. If a prize results, the prize is paid according to the paytable of the first game A second game is then played without any intervention of the player. For the second game, a second set of reel strips is used and, where applicable, prizes are paid according to a second paytable.

In yet a further embodiment (not shown), two completely different styles or types of game are provided to the player for each wager made by the player. Thus, a spinning reel game may be followed by a card game or a 5 reel game may be followed by a 3 reel game for each bet made.

Still further, the rules applicable to each game offered to a player for a single wager may differ. For example, the same reel strips may be used for both games but for the first game, a combination of five diamonds may pay a prize of 5000 credits whereas in the second game the same combination may pay a prize of 10 000 credits. Similarly, 1 diamond may pay 5 credits in the first game and zero credits in the second game. Another example is that 3 scattered diamonds may trigger a free game series in the first game and the same combination may trigger a second screen animation in the second game. Yet a further example is that all prizes of the second game are double what they were in the first game.

A further embodiment (not shown) is where the result of the second game is somehow dependent on the result of the first game. Thus, for example, the first game may have some condition which triggers alterations in the second game such as where, if 3× scatters are won on the first game, any prize won on the second game is doubled. Instead, the second game win may be related to the first game win. Thus, if the first game results in a win and the second game also results in win, the win from the first game is awarded again in respect of the second game in addition to the prize for the second game.

Figure 6A:
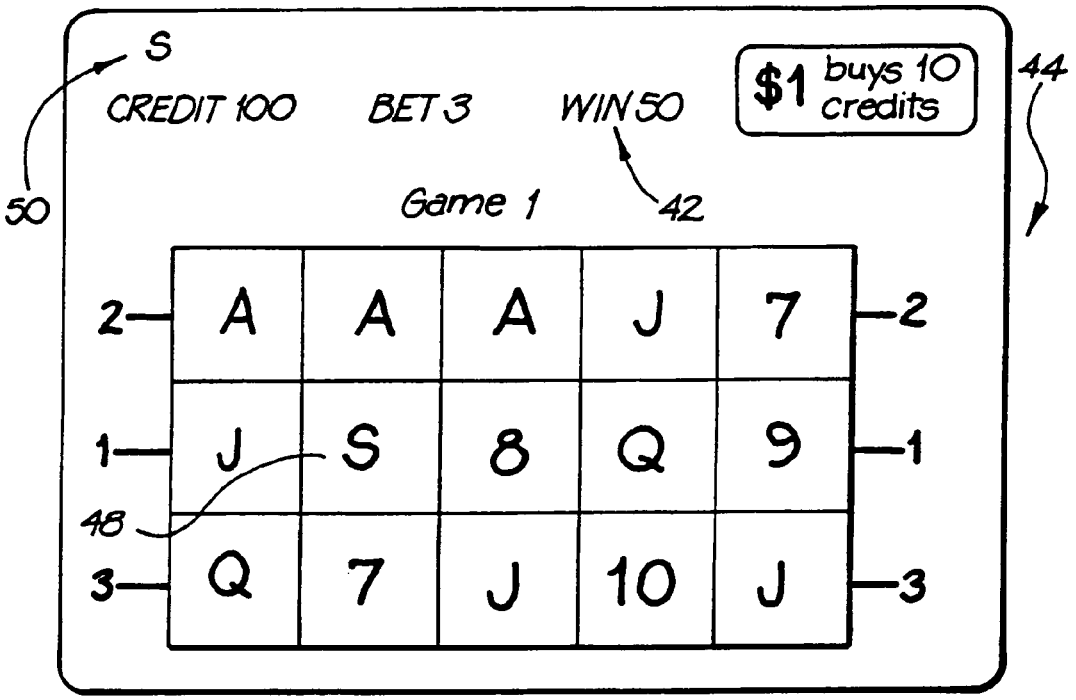
FIGS. 6*a* and 6*b* show screen displays of a further embodiment of a game sequence of a game played on the gaming machine of FIG. 1.
Figure 6B:
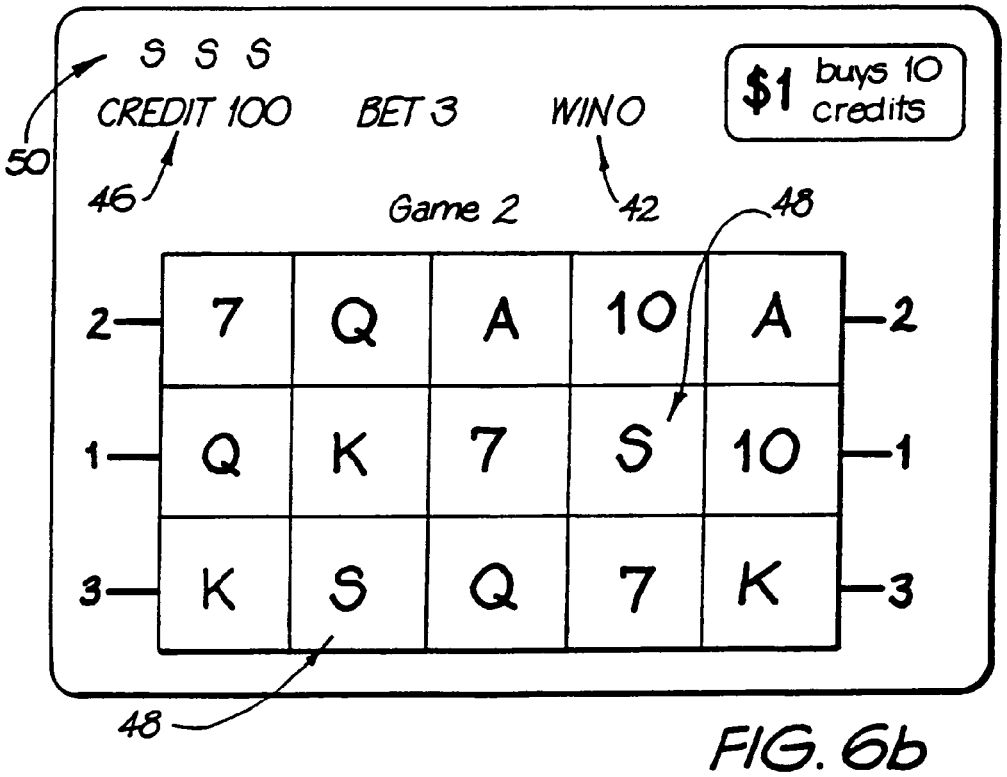
Figure 7:
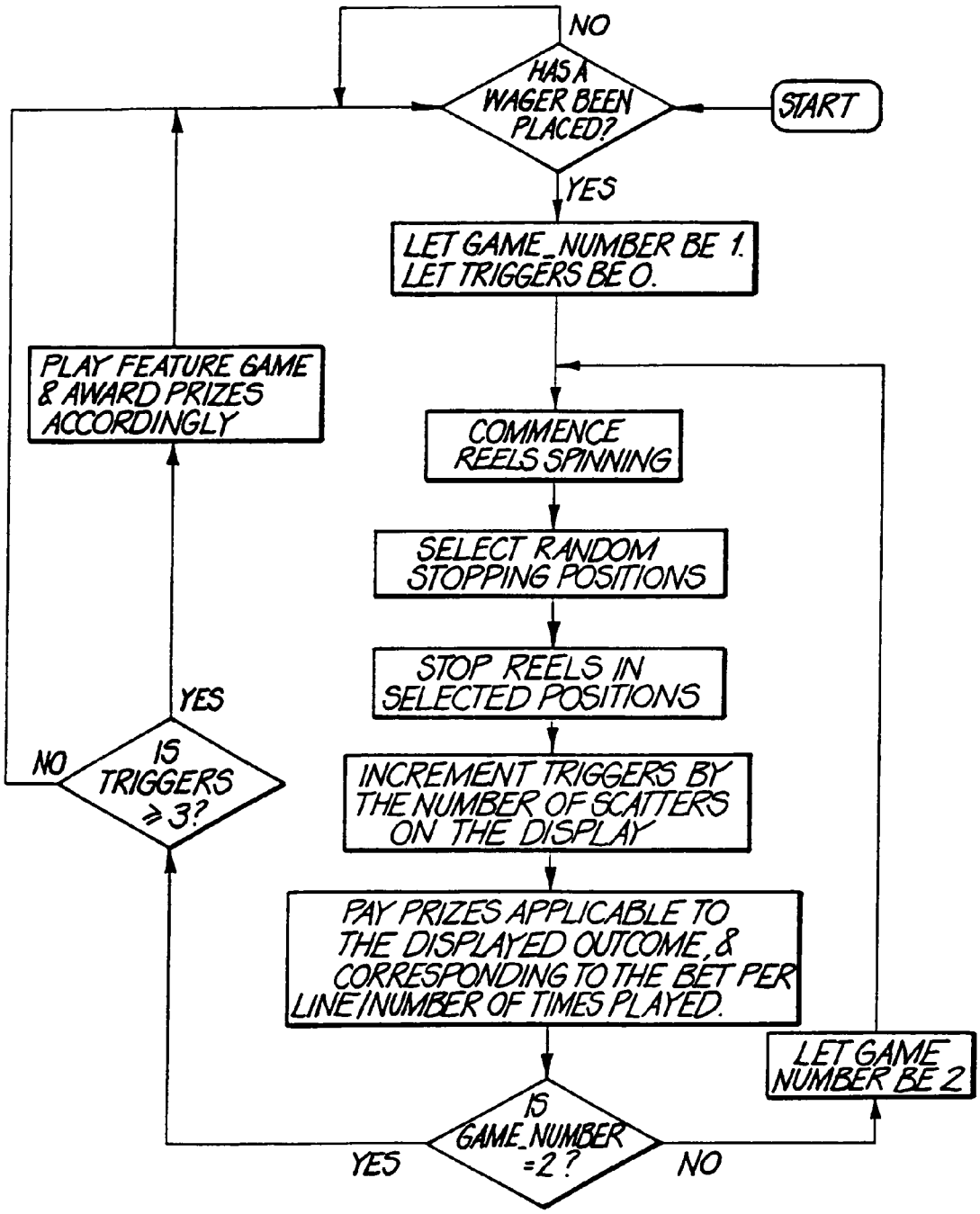
FIG. 7 shows a flow chart of the game sequence of FIG. 6.

In the embodiment shown in FIGS. 6*a* and 6*b*, an enhancement is provided where, in addition to the paying of prizes, as appropriate, in the first and second games of a game sequence, predetermined symbols, such as the scatter symbol 48, are accumulated during the game sequence and, when a predetermined number of the symbols (for example, 3 scatter symbols) have been accumulated as shown at 50 in FIGS. 6*a* and 6*b*, a feature is triggered. The feature may be a free game series, a second screen animation, or the like. It is to be noted that the scatter symbols 48 are accumulated irrespective of whether or not any prize winning combination of symbols occurs. Hence, as shown in FIG. 6*b* of the drawings, two scatter symbols 48 are accumulated in the second game of the sequence even though no other prize winning event occurred. In view of the fact that a scatter symbol 48 had previously been accumulated in the first game of the sequence (as shown in FIG. 6*a*), the trigger condition is met and the feature is triggered.

It will be appreciated that, if desired more than two games can be awarded for each wager. Further, other variations will readily suggest themselves to one skilled in the art.

In addition, although the player is not required to place a wager on the second or subsequent games, it may still be required that the player needs to actively select both games, for example, by an appropriate button.

It is a particular advantage of the invention that, effectively, a base game denomination is lowered. Those skilled in the art will appreciate that, due to the availability of particular tokens, a machine having a denomination of as low as one cent is available. With the provision of multiple games for one wager, the effect is to lower the denomination further.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine, comprising:

a gaming console;

a display mounted in the gaming console, the display being operable to display a wagering game and its result; and a controller adapted to control operation of the wagering game, to permit a player to stake a wager on the wagering game, to play the game once the player has staked the wager, and to award one or more prizes in the event of winning results in said wagering game;

wherein, for every wager made by the player, the controller is adapted to play a first game and then a subsequent second game on the display, wherein the controller is adapted to initiate play of the second game automatically after the first game has been completed, irrespective of the result of the first game and absent any requirement for a trigger event to occur in the first game, wherein the controller is adapted to award a prize in the event of a winning result on either or both of the first game and the second game, wherein the controller is adapted to play the second game without intervention by the player to provide the player with at least two games for the price of a single wager; and wherein the controller is adapted to alter an aspect of the second game in response to a particular outcome of the first game.

2. The gaming machine of claim 1 in which the first and second games have the same functionality and the second game is played without intervention of the player.

3. The gaming machine of claim 1 in which the first and second games are identical.

4. The gaming machine of claim 1 in which the first and second games are different games.

5. The gaming machine of claim 4 in which the first and second games are different styles or types of games.

6. The gaming machine of claim 4 in which the rules applicable to each game differ.

7. The gaming machine of claim 2 in which the result of the second game is dependent on the result of the first game.

8. The gaming machine of claim 2 in which predetermined symbols appearing in the result of the first game and predetermined symbols appearing in the result of the second game together constitute a trigger condition for triggering a bonus feature.

9. The gaming machine of claim 3 in which predetermined symbols appearing in the result of the first game and predetermined symbols appearing in the result of the second game together constitute a trigger condition for triggering a bonus feature.

10. The gaming machine of claim 4 in which predetermined symbols appearing in the result of the first game and predetermined symbols appearing in the result of the second game together constitute a trigger condition for triggering a bonus feature.

11. The gaming machine of claim 5 in which predetermined symbols appearing in the result of the first game and predetermined symbols appearing in the result of the second game together constitute a trigger condition for triggering a bonus feature.

12. The gaming machine of claim 6 in which predetermined symbols appearing in the result of the first game and predetermined symbols appearing in the result of the second game together constitute a trigger condition for triggering a bonus feature.

13. The gaming machine of claim 7 in which predetermined symbols appearing in the result of the first game and predetermined symbols appearing in the result of the second game together constitute a trigger condition for triggering a bonus feature.

14. The gaming machine of claim 1 in which the result of the first game and the result of the second game are able to be combined to achieve a winning result, and the control means is adapted to make the combination and award a prize reflective of the combined result at the completion of the second game.

15. The gaming machine of claim 1 in which the first game and the second game are different from each other, the second game being played after the completion of the first game without intervention of the player at the end of the first game, a prize being awarded in the event of a winning result at the end of the first game and in the event of a winning result at the end of the second game.

16. The gaming machine of claim 15 in which the result of the first game and the result of the second game are able to be combined to achieve a combined winning result, and the control means is adapted to make the combination and award a prize reflective of the combined winning result at the completion of the second game, irrespective of any prizes that might also have been awarded in respect of winning result achieve in said first game and said second game.

17. The gaming machine according to claim 1, wherein a further wager is able to be made by the player prior to completion of the second game, the further wager allowing the player to increase the award prizes in the event of a winning result during the wagering game.

18. A method, comprising:

accepting a wager with a wagering gaming machine during operation;

playing with the wagering gaming machine, for every wager made by the player, a first game and a subsequent second game irrespective of the result of the first game;

awarding with the wagering gaming machine a prize in the event of a winning result on either or both of the first game and the second game;

wherein said playing a first game and a subsequent second game comprises playing the second game without intervention by the player to provide the player with at least two games for the price of a single wager, and wherein said playing a first game and a subsequent second game comprises altering an aspect of the second game in response to a particular outcome of the first game.

19. The method of claim 18, further comprising:

awarding a win in the second game based on a result of the first game.

20. The method of claim 18, further comprising:

spinning reels during the first game;

automatically re-spinning the reels to initiate play of the second game without any further intervention from the player; and determining winning results of the first and second game based on a final state of the reels in each game.

21. A gaming machine, comprising:

a display; and a processor that controls operation of a wagering game;

wherein the processor is configured to permit a player to stake a wager on the wagering game, to play the game once the player has staked the wager, and to award a prize in the event of winning results in the wagering game;

wherein the processor is configured, for every wager made by the player, to play a first game and subsequently a second game on the display, the second game being played irrespective of the result of the first game;

wherein the processor is configured to play the second game without intervention by the player to provide the player with at least two games for the price of a single wager;

wherein the processor is configured to award the prize in the event of a winning result on either or both of the first game and the second game, and wherein the processor is configured to alter an aspect of the second game in response to a particular outcome of the first game.

22. The gaming machine of claim 21, wherein the processor is configured to award a win in the second game based on a result of the first game.

23. The gaming machine of claim 22, wherein the processor is configured spin reels to initiate play of the first game and to automatically re-spin the reels to initiate play of the second game without any further intervention from the player.

* * * * *